US011998822B2

(12) United States Patent
Kwak et al.

(10) Patent No.: US 11,998,822 B2
(45) Date of Patent: Jun. 4, 2024

(54) MAT, METHOD AND PROGRAM FOR MEASURING GOLF POSTURE CAPABLE OF MEASURING GOLF CLUB SWING SPEED

(71) Applicant: Morethings Co., Ltd., Yongin-si (KR)

(72) Inventors: Jae Kyung Kwak, Yongin-si (KR); Ji Won Oh, Gwangju-si (KR); Hwan Il Park, Suwon-si (KR); Jeong Min Han, Seoul (KR)

(73) Assignee: Morethings Co., Ltd., Yongin-si (KR)

( * ) Notice: Subject to any disclaimer, the term of this patent is extended or adjusted under 35 U.S.C. 154(b) by 412 days.

(21) Appl. No.: 17/561,247

(22) Filed: Dec. 23, 2021

(65) Prior Publication Data

US 2023/0191223 A1 Jun. 22, 2023

(30) Foreign Application Priority Data

Dec. 22, 2021 (KR) ..... 10-2021-0184725

(51) Int. Cl.

| | |
|---|---|
| ***A63B 69/36*** | (2006.01) |
| ***A63B 24/00*** | (2006.01) |
| ***A63B 71/06*** | (2006.01) |

(52) U.S. Cl.

CPC ..... *A63B 69/36* (2013.01); *A63B 24/0006* (2013.01); *A63B 71/0622* (2013.01); *A63B 2024/0012* (2013.01); *A63B 2220/30* (2013.01); *A63B 2220/52* (2013.01); *A63B 2220/56* (2013.01); *A63B 2220/62* (2013.01); *A63B 2220/833* (2013.01)

(58) Field of Classification Search

CPC ... A63B 69/36; A63B 24/006; A63B 71/0622; A63B 2024/0012; A63B 2220/30; A63B 2220/52; A63B 2220/56; A63B 2220/62; A63B 2220/833

See application file for complete search history.

(56) References Cited

U.S. PATENT DOCUMENTS

2007/0196800 A1* 8/2007 Douthit ..... A63B 69/3667 434/252

* cited by examiner

*Primary Examiner* — Thomas H Henry

(74) *Attorney, Agent, or Firm* — Studebaker & Brackett PC

(57) ABSTRACT

Disclosed is a mat, method, and program for measuring a golf posture that are capable of measuring a golf club swing speed. The golf posture measuring mat capable includes a sensor unit sensing a pressure corresponding to a golf posture of a user and a trajectory of a head of a golf club, a control unit analyzing the golf posture of the user and a swing speed of the golf club based on a sensed signal of the sensor unit, a display unit displaying analysis data analyzed by the control unit, and a storage unit storing the analysis data and reference data. A plurality of sensors in the sensor unit are arranged one-dimensionally or two-dimensionally on a mat plate. Each of the plurality of sensors includes a single sensor including one among a capacitive pressure sensor, a resistive pressure sensor, and a hybrid pressure sensor, or includes a composite sensor including two or more among the capacitive pressure sensor, the resistive pressure sensor, and the hybrid pressure sensor.

15 Claims, 16 Drawing Sheets

MAT, METHOD AND PROGRAM FOR MEASURING GOLF POSTURE CAPABLE OF MEASURING GOLF CLUB SWING SPEED

TECHNICAL FIELD

Embodiments of the inventive concept described herein relate to a golf posture measuring mat, and more particularly, relate to a mat, method, and program for measuring a golf posture that are capable of measuring golf club swing speed.

BACKGROUND

In general, factors that affect the driving distance of golf are the accuracy of a golfer's posture and the head speed of a club at an impact.

Accordingly, various golf simulators measure a swing speed based on a video by capturing the golfer's posture and a club swing at high speed by using a camera and comparing movement amounts of a club head between image frames captured at a high speed.

However, a fact that the golfer's posture and a club swing speed are measured based on a video is affected by camera performance, and thus there is a need for a high-performance camera and a high-performance signal processing system capable of processing high-speed images.

Such the high-performance camera and the high-performance signal processing systems increase manufacturing costs and installation costs of a golf simulator, and thus it is a burden for golfers who need golf posture correction training.

Accordingly, there is a need to develop a simple and inexpensive measurement method while the club swing speed and golf posture are accurately measured in a simple way without a high-performance camera and signal processing system.

DISCLOSURE

Technical Task

Embodiments of the inventive concept provide a mat, method, and program for measuring a golf posture, which are capable of measuring a golf club swing speed and which are capable of measuring a club swing speed and a golf posture accurately, easily, and inexpensively in a simple way without a high-performance camera and a high-performance signal processing system, by analyzing a user's golf posture and club swing speed based on the sensed signal of a sensor unit where a plurality of sensors are arranged one-dimensionally or two-dimensionally on a mat plate.

Problems to be solved by the inventive concept are not limited to the problems mentioned above, and other problems not mentioned will be clearly understood by those skilled in the art from the following description.

Technical Solution

According to an embodiment, a golf posture measuring mat capable of measuring a speed of a golf club includes a sensor unit sensing a pressure corresponding to a golf posture of a user and a trajectory of a head of a golf club, a control unit analyzing the golf posture of the user and a swing speed of the golf club based on a sensed signal of the sensor unit, a display unit displaying analysis data analyzed by the control unit, and a storage unit storing the analysis data and reference data. A plurality of sensors in the sensor unit are arranged one-dimensionally or two-dimensionally on a mat plate. Each of the plurality of sensors includes a single sensor including one among a capacitive pressure sensor, a resistive pressure sensor, and a hybrid pressure sensor, or includes a composite sensor including two or more among the capacitive pressure sensor, the resistive pressure sensor, and the hybrid pressure sensor. The control unit is configured to determine a tee location by analyzing a location of a golf ball based on the sensed signal of the sensor unit when receiving body information of the user, to determine an address posture by analyzing a pressure center point of the user and a location of the head of the golf club; to estimate a center-of-gravity of the user by reflecting the pressure center point of the user and the received body information of the user, to determine a swing by reflecting a change in a plantar pressure of the user, the pressure center point of the user, and the center-of-gravity of the user corresponding to a change in the golf posture of the user, to determine an impact corresponding to a weight change of the tee location, to calculate the swing speed of the golf club before and after the impact, to analyze the golf posture of the user by comparing a change in the plantar pressure of the user, a change in the pressure center point of the user, and a change in the center-of-gravity of the user corresponding to the change in the golf posture of the user with the reference data, and to control the display unit so as to display the analysis data including the analyzed golf posture of the user and the swing speed of the golf club.

In an embodiment, in the sensor unit, single sensors, each of which includes one of the capacitive pressure sensor, the resistive pressure sensor, and the hybrid pressure sensor, are arranged one-dimensionally or two-dimensionally on the mat plate.

In an embodiment, in the sensor unit, a first sensor group including a plurality of capacitive pressure sensors and a second sensor group including a plurality of resistive pressure sensors are arranged one-dimensionally on the mat plate; or in the sensor unit, the first sensor group including the plurality of capacitive pressure sensors and the second sensor group including the plurality of resistive pressure sensors are arranged two-dimensionally on the mat plate.

In an embodiment, the capacitive pressure sensors of the first sensor group are arranged at an upper portion of the mat plate so as to sense a trajectory of the head of the golf club; and the resistive pressure sensors of the second sensor group are arranged at a lower portion of the mat plate so as to sense the pressure corresponding to the golf posture of the user.

In an embodiment, the capacitive pressure sensors of the first sensor group are arranged at unequal intervals at the upper portion of the mat plate in a lateral direction and arranged at equal intervals at the upper portion of the mat plate in a longitudinal direction; and, the resistive pressure sensors of the second sensor group are arranged at equal intervals at the lower portion of the mat plate in the lateral direction and the longitudinal direction.

In an embodiment, in the sensor unit, a first sensor group including a plurality of capacitive pressure sensors is arranged one-dimensionally on the mat plate, and a second sensor group including a plurality of resistive pressure sensors is arranged two-dimensionally on the mat plate; or the first sensor group including the plurality of capacitive pressure sensors is arranged two-dimensionally on the mat plate, and the second sensor group including the plurality of resistive pressure sensors is arranged one-dimensionally on the mat plate.

In an embodiment, when determining a tee location, the control unit determines whether the sensed signal corresponds to a location of a golf ball, by processing the received sensed signal when the control unit receives the user's body information and then a sensed signal is received from the sensor unit, and then determines the tee location based on the location of the golf ball when the sensed signal corresponds to the location of the golf ball.

In an embodiment, when determining the address posture, the control unit is configured to determine whether the sensed signal corresponds to the plantar pressure of the user and the location of the head of the golf club, by processing the sensed signal when the sensed signal is received from the sensor unit, to calculate the pressure center point of the user from the plantar pressure when the sensed signal corresponds to the plantar pressure of the user and the location of the head of the golf club, and to determine the address posture based on the pressure center point of the user and the location of the golf club head.

In an embodiment, when determining the address posture, the control unit determines that a current location of the driver head is a start point of the swing.

In an embodiment, when determining the start point of the swing, the control unit generates a notification signal for providing a notification of swing preparation.

In an embodiment, when determining the swing, the control unit determines whether the sensed signal corresponds to the change in the golf posture of the user corresponding to the change in the plantar pressure of the user, the change in the pressure center point of the user, and the change in the center-of-gravity of the user, by processing the received sensed signal when the sensed signal is received from the sensor unit and determines the swing of the user based on the change in the plantar pressure of the user, the change in the pressure center point of the user, and the change in the center-of-gravity of the user when the sensed signal corresponds to the change in the golf posture of the user.

In an embodiment, the control unit determines that a point in time when the head of the golf club deviates from the mat plate based on the start point of the swing is a point in time when a backswing is entered, based on the sensed signal and then calculates a backswing speed of the user based on a speed and a time from the start point of the swing to a point in time when the head of the golf club head deviates from the mat plate.

In an embodiment, the control unit measures a time required for the head of the golf club to enter the mat plate and then to pass through the start point of the swing, from the sensed signal and calculates a speed of the head of the golf club based on the measured time.

In an embodiment, the control unit measures a time, which is required for the golf club head to leave the mat plate from the start point of the swing and then to return to the start point of the swing, from the sensed signal of the sensor and calculates a time from the start of the swing to an impact based on the measured time.

According to an embodiment, a golf club speed and golf posture measuring method of a golf posture measuring mat including a control unit that analyzes a golf posture of a user and a predetermined swing speed of a golf club based on a sensed signal of a sensor unit includes determining, by the control unit, a tee location by analyzing a location of a golf ball based on the sensed signal of the sensor unit when receiving body information of the user, determining, by the control unit, an address posture by analyzing a pressure center point of the user and a location of a head of the golf club, estimating, by the control unit, a center-of-gravity of the user by reflecting the pressure center point of the user and the received body information of the user, determining, by the control unit, a swing by reflecting a change in the plantar pressure of the user, the pressure center point of the user, and the center-of-gravity of the user corresponding to a change in the golf posture of the user, determining, by the control unit, an impact corresponding to a weight change of the tee location, calculating, by the control unit, a swing speed of the golf club before and after the impact, analyzing, by the control unit, the golf posture of the user by comparing the change in the plantar pressure of the user, the pressure center point of the user, and the center-of-gravity of the user corresponding to the change in the golf posture of the user with reference data, and controlling, by the control unit, analysis data including the analyzed golf posture of the user and the swing speed of the golf club to be displayed.

According to an embodiment, a computer program providing a golf club speed and golf posture measuring method of a golf posture measuring mat, which is stored in a medium combined with a computer being a piece of hardware to execute one of the above-described methods.

In addition, another method and another system for implementing the inventive concept, and a computer-readable recording medium for recording a computer program for performing the method may be further provided.

Technical Effect

According to an embodiment of the inventive concept, it is possible to measure a golf club speed and a golf posture accurately, easily, and inexpensively in a simple way without a high-performance camera and a high-performance signal processing system, by analyzing a user's golf posture and golf club swing speed based on the sensed signal of a sensor unit where a plurality of sensors are arranged one-dimensionally or two-dimensionally on a mat plate.

Effects of the inventive concept are not limited to the effects mentioned above, and other effects not mentioned will be clearly understood by those skilled in the art from the following description.

DETAILED DESCRIPTION

Figure 1:
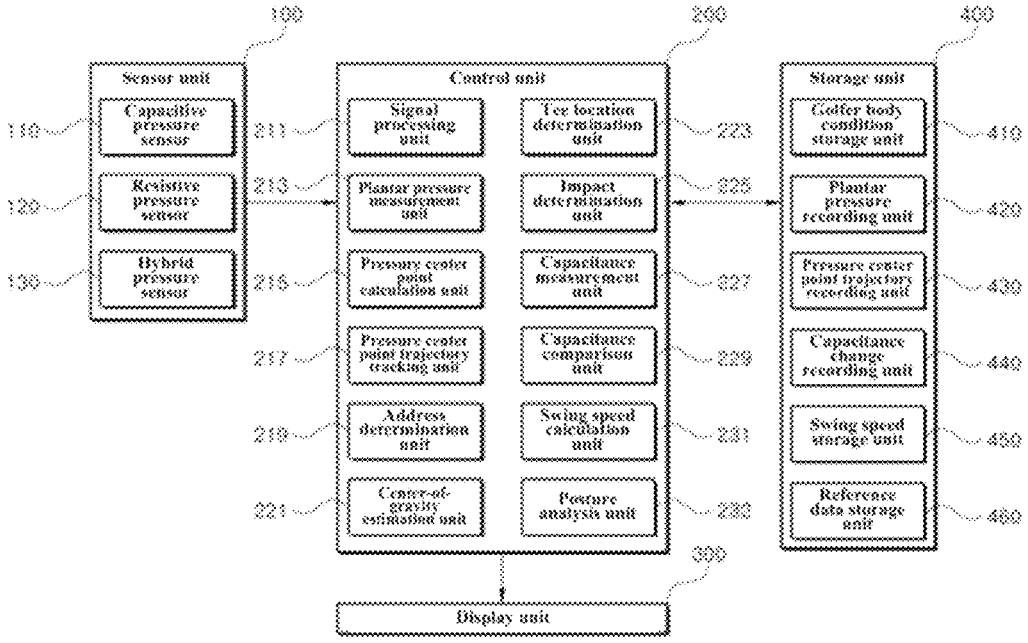
FIG. 1 is a block diagram illustrating a golf posture measuring mat capable of measuring a golf club speed, according to an embodiment of the inventive concept.

The above and other aspects, features and advantages of the inventive concept will become apparent from the following description of the following embodiments given in conjunction with the accompanying drawings. The inventive concept, however, may be embodied in various different forms, and should not be construed as being limited only to the illustrated embodiments. Rather, these embodiments are provided as examples so that the inventive concept will be thorough and complete, and will fully convey the scope of the inventive concept to those skilled in the art. The inventive concept may be defined by the scope of the claims.

The terms used herein are provided to describe embodiments, not intended to limit the inventive concept. In the specification, the singular forms include plural forms unless particularly mentioned. The terms "comprises" and/or "comprising" used herein do not exclude the presence or addition of one or more other components, in addition to the aforementioned components. The same reference numerals denote the same components throughout the specification. As used herein, the term "and/or" includes each of the associated components and all combinations of one or more of the associated components. It will be understood that, although the terms "first", "second", etc., may be used herein to describe various components, these components should not be limited by these terms. These terms are only used to distinguish one component from another component. Thus, a first component that is discussed below could be termed a second component without departing from the technical idea of the inventive concept.

Unless otherwise defined, all terms (including technical and scientific terms) used herein have the same meaning as commonly understood by those skilled in the art to which the inventive concept pertains. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein.

Hereinafter, embodiments of the inventive concept will be described in detail with reference to accompanying drawings.

Prior to a description, the meaning of terms used in the present specification will be described briefly. However, because the description of terms is used to help the understanding of this specification, it should be noted that if the inventive concept is not explicitly described as a limiting matter, it is not used in the sense of limiting the technical idea of the inventive concept.

FIG. 1 is a block diagram illustrating a golf posture measuring mat capable of measuring a golf club speed, according to an embodiment of the inventive concept.

As illustrated in FIG. 1, the inventive concept may include a sensor unit 100 that senses a pressure corresponding to a user's golf posture and the trajectory of a golf club head, a control unit 200 that analyzes the user's golf posture and a swing speed of a golf club based on the sensed signal of the sensor unit 100, a display unit 300 that displays analysis data analyzed by the control unit 200, and a storage unit 400 that stores the analysis data and reference data.

The golf club according to an embodiment of the inventive concept may include at least one of a driver, a plurality of woods (e.g., 3-wood to 5-wood, or the like), a plurality of utilities (e.g., 3-utility to 5-utility, or the like), and a plurality of irons (e.g., 3-iron to 9-iron, pitching wedges, sand wedges, or the like). According to an embodiment of the inventive concept, in a golf club of which the swing speed is measured, one of the above-mentioned clubs may be set as default or the setting thereof may be changed by the user. In the following description, it is assumed that the golf club is a "driver". The inventive concept is not limited thereto, and it is obvious that the inventive concept is capable of being applied not only to the "driver" but also to all the clubs described above.

Here, in the sensor unit 100, a plurality of sensors may be arranged one-dimensionally or two-dimensionally on a mat plate.

For example, each of the plurality of sensors may be a single sensor including one of a capacitive pressure sensor 110, a resistive pressure sensor 120, and a hybrid pressure sensor 130; alternatively, each of the plurality of sensors may be a composite sensor including two or more among the capacitive pressure sensor 110, the resistive pressure sensor 120, and the hybrid pressure sensor 130.

In an embodiment, in the sensor unit 100, single sensors, each of which includes one of the capacitive pressure sensor 110, the resistive pressure sensor 120, and the hybrid pressure sensor 130, may be arranged one-dimensionally or two-dimensionally on the mat plate.

Here, the single sensors may be arranged at equal intervals in lateral and longitudinal directions of the mat plate.

In some cases, the single sensors may be arranged at unequal intervals in the lateral direction of the mat plate and may be arranged at equal intervals in the longitudinal direction of the mat plate.

Here, the single sensors arranged in the lateral direction may be arranged such that an interval between the single sensors gradually narrows from one side of the mat plate to a center area of the mat plate and then gradually widens from the center area to the other side.

In another embodiment, in the sensor unit 100, a first sensor group including a plurality of capacitive pressure sensors and a second sensor group including a plurality of resistive pressure sensors may be arranged one-dimensionally on a mat plate. Alternatively, the first sensor group including a plurality of capacitive pressure sensors and the second sensor group including a plurality of resistive pressure sensors may be arranged two-dimensionally on the mat plate.

Here, the capacitive pressure sensors of the first sensor group are arranged at an upper portion of the mat plate to sense the trajectory of a driver head. The resistive pressure sensors of the second sensor group are arranged at a lower portion of the mat plate to sense a pressure corresponding to the user's golf posture.

At this time, the capacitive pressure sensors of the first sensor group may be arranged at equal intervals in the lateral direction and the longitudinal direction at the upper portion of the mat plate. The resistive pressure sensors of the second sensor group may be arranged at equal intervals in the lateral direction and the longitudinal direction at the lower portion of the mat plate.

Furthermore, an interval between the capacitive pressure sensors arranged in the lateral direction may be the same as an interval between the resistive pressure sensors arranged in the lateral direction. An interval between the capacitive pressure sensors arranged in the longitudinal direction may be the same as an interval between the resistive pressure sensors arranged in the longitudinal direction.

In some cases, the capacitive pressure sensors of the first sensor group may be arranged at unequal intervals in the lateral direction at the upper portion of the mat plate and may be arranged at equal intervals in the longitudinal direction at the upper portion of the mat plate. The resistive pressure sensors of the second sensor group may be arranged at equal intervals in the lateral direction and the longitudinal direction at the lower portion of the mat plate.

Here, an interval between the capacitive pressure sensors arranged in the lateral direction may be different from an interval between the resistive pressure sensors arranged in the lateral direction. An interval between the capacitive pressure sensors arranged in the longitudinal direction may be the same as an interval between the resistive pressure sensors arranged in the longitudinal direction.

For example, the capacitive pressure sensors arranged in the lateral direction may be arranged such that an interval between the capacitive pressure sensors gradually narrows from one side of the upper portion of the mat plate to a center area of the upper portion of the mat plate and then gradually widens from the center area to the other side.

Moreover, the number of capacitive pressure sensors of the first sensor group may be less than the number of resistive pressure sensors of the second sensor group.

The number of capacitive pressure sensors in the first sensor group that measures the driver's speed is not needed to be greater than the number of resistive pressure sensors in the second sensor group that measures a user's golf posture. This is to make a mat compact such that the user is capable of conveniently transporting the mat, by minimizing the size of the mat by using the smallest sensor.

In another embodiment, in the sensor unit 100, a first sensor group including a plurality of capacitive pressure sensors may be arranged one-dimensionally on a mat plate; and, a second sensor group including a plurality of resistive pressure sensors may be arranged two-dimensionally on the mat plate. Alternatively, the first sensor group including a plurality of capacitive pressure sensors may be arranged two-dimensionally on the mat plate; and, and the second sensor group including a plurality of resistive pressure sensors may be arranged one-dimensionally on the mat plate.

Here, the capacitive pressure sensors of the first sensor group are arranged at an upper portion of the mat plate to sense the trajectory of a driver head. The resistive pressure sensors of the second sensor group are arranged at a lower portion of the mat plate to sense a pressure corresponding to the user's golf posture.

Also, the capacitive pressure sensors of the first sensor group may be arranged at equal intervals in the lateral direction and the longitudinal direction at the upper portion of the mat plate. The resistive pressure sensors of the second sensor group may be arranged at equal intervals in the lateral direction and the longitudinal direction at the lower portion of the mat plate.

Here, an interval between the capacitive pressure sensors arranged in the lateral direction may be the same as an interval between the resistive pressure sensors arranged in the lateral direction. An interval between the capacitive pressure sensors arranged in the longitudinal direction may be the same as an interval between the resistive pressure sensors arranged in the longitudinal direction.

In some cases, the capacitive pressure sensors of the first sensor group may be arranged at unequal intervals in the lateral direction at the upper portion of the mat plate and may be arranged at equal intervals in the longitudinal direction at the upper portion of the mat plate. The resistive pressure sensors of the second sensor group may be arranged at equal intervals in the lateral direction and the longitudinal direction at the lower portion of the mat plate.

Here, an interval between the capacitive pressure sensors arranged in the lateral direction may be different from an interval between the resistive pressure sensors arranged in the lateral direction. An interval between the capacitive pressure sensors arranged in the longitudinal direction may be the same as an interval between the resistive pressure sensors arranged in the longitudinal direction.

At this time, the capacitive pressure sensors arranged in the lateral direction may be arranged such that an interval between the capacitive pressure sensors gradually narrows from one side of the upper portion of the mat plate to a center area of the upper portion of the mat plate and then gradually widens from the center area to the other side.

Moreover, the number of capacitive pressure sensors of the first sensor group may be less than the number of resistive pressure sensors of the second sensor group.

Besides, the capacitance of the capacitive pressure sensor 110 of the sensor unit 100 may be changed depending on a distance from a driver and the user's pressure; the resistance of the resistive pressure sensor 120 of the sensor unit 100 may be changed depending on the distance from the driver and the user's pressure; and, the capacitance and resistance of the hybrid pressure sensor 130 of the sensor unit 100 may be changed depending on the distance from the driver and the user's pressure.

Next, the control unit 200 may determine a tee location by analyzing a location of a golf ball based on the sensed signal of the sensor unit 100 when receiving the user's body information, may determine an address posture by analyzing a pressure center point of the user and a location of a driver head, may estimate a center-of-gravity of the user by reflecting the pressure center point of the user and the received body information of the user, may determine a swing by reflecting the change in a plantar pressure of the user, the pressure center point of the user, and the center-of-gravity of the user corresponding to a change in the golf posture of the user, may determine an impact corresponding to a weight change of the tee location, may calculate the swing speed of the driver before and after the impact, may analyze the user's golf posture by comparing a change in the plantar pressure, the pressure center point, and the center-of-gravity of the user corresponding to the user's golf posture change with reference data, and may control the display unit 300 to display analysis data including the analyzed golf posture of the user and the swing speed of the driver.

Here, in the case where the control unit 200 determines a tee location, when the control unit 200 receives the user's body information and then a sensed signal is received from the sensor unit 100, the control unit 200 may determine whether the sensed signal corresponds to a location of a golf ball, by processing the received sensed signal. When the sensed signal corresponds to the location of the golf ball, the control unit 200 may determine the tee location based on the location of the golf ball.

Moreover, in the case where the control unit 200 determines an address posture, when the sensed signal is received from the sensor unit 100, the control unit 200 may determine whether the sensed signal corresponds to the user's plantar pressure and the location of the driver head, by processing the received sensed signal. When the sensed signal corresponds to the user's plantar pressure and the location of the driver head, the control unit 200 may calculate the user's pressure center point from the plantar pressure and may determine the address posture based on the user's pressure center point and the location of the driver head.

Here, when determining the address posture, the control unit 200 may determine that a current location of the driver head is a start point of the swing.

Then, when determining the start point of the swing, the control unit 200 may generate a notification signal for providing a notification of swing preparation.

For example, when generating a notification signal, the control unit 200 may provide a notification in at least one method of a first notification method of outputting a specific sound by using a speaker, a second notification method of vibrating a diaphragm, a third notification method of turning on/off a warning light, and a fourth notification method of displaying a notification including at least one of a text, an image, a picture, a design, and a message on a display screen.

Next, when estimating the center-of-gravity of the user, the control unit 200 may determine whether the received body information of the user is stored in advance. When there is pre-stored body information of the user, the control unit 200 may estimate the user's center-of-gravity based on the user's pressure center point and body information.

Here, in the case where the control unit 200 estimates the user's center-of-gravity, when the pre-stored body information of the user is not present, the control unit 200 may control the display unit 300 so as to display an input request message for the user's body information or to display a notification that the user's body information is not present.

Then, in the case where the control unit 200 determines the swing, when the sensed signal is received from the sensor unit 100, the control unit 200 may determine whether the sensed signal corresponds to the user's golf posture change such as a change in the user's plantar pressure, a change in the pressure center point, and a change in center-of-gravity, by processing the received sensed signal. When the sensed signal corresponds to the user's golf posture change, the control unit 200 may determine the user's swing based on a change in the user's plantar pressure, a change in the pressure center point, and a change in the center-of-gravity.

Here, right before determining the user's swing, the control unit 200 may determine a current location of the driver head as the start point of the swing.

Moreover, the control unit 200 may determine that a point in time when a driver head deviates from a mat plate based on the start point of the swing is a point in time when a backswing is entered, based on the sensed signal. The control unit 200 may calculate the user's backswing speed based on a speed and a point in time when the driver head deviates from the mat plate based on the start point of the swing.

Besides, the control unit 200 may measure a time required for the driver head to enter the mat plate and then to pass through the start point of the swing, from the sensed signal and then may calculate the speed of the driver head based on the measured time.

In addition, the control unit 200 may measure a time, which is required for the driver head to leave the mat plate from the start point of the swing and then to return to the start point of the swing, from the sensed signal; and, the control unit 200 may calculate a time from the start of the swing to an impact based on the measured time.

As such, the control unit 200 may include a signal processing unit 211 that processes a sensed signal received from the sensor unit 100, a plantar pressure measurement unit 213 that measures the user's plantar pressure change corresponding to the user's golf posture, a pressure center point calculation unit 215 that calculates the user's pressure center point corresponding to the user's golf posture, a pressure center point trajectory tracking unit 217 that tracks a movement of the calculated pressure center point of the user, an address determination unit 219 that determines an address posture by analyzing the user's pressure center point and the location of the driver head, a center-of-gravity estimation unit 221 that estimates the user's center-of-gravity by reflecting the user's pressure center point and the received user's body information, a tee location determination unit 223 that determines a tee location by analyzing a location of a golf ball based on the sensed signal of the sensor unit 100, an impact determination unit 225 that determines an impact corresponding to a change in weight of the tee location, a capacitance measurement unit 227 that measures a capacitance change corresponding to a trajectory of the driver head, a capacitance comparison unit 229 that compares the capacitance change corresponding to the driver head with a capacitance change stored in advance, a swing speed calculation unit 231 that calculates a swing speed of the driver head based on the comparison result of the capacitance change, and a posture analysis unit 232 that analyzes the user's golf posture by comparing a change in the user's plantar pressure, pressure center point, and a center-of-gravity corresponding to the user's golf posture change with reference data.

Furthermore, the storage unit 400 may include a golfer body condition storage unit 410 that stores the received body information of the user, a plantar pressure recording unit 420 that records a plantar pressure measured from the plantar pressure measurement unit 213 in chronological order, a pressure center point trajectory recording unit 430 that records the pressure center point tracked from the pressure center point trajectory tracking unit 217, a capacitance change recording unit 440 that records a capacitance change measured from the capacitance measurement unit 227 in chronological order, a swing speed storage unit 450 that stores the swing speed of the golf club head calculated from the swing speed calculation unit 231, and a reference data storage unit 460 that stores the reference data for comparing the user's golf posture.

As such, in an embodiment of the inventive concept, it is possible to measure a driver speed and a golf posture accurately, easily, and inexpensively in a simple way without a high-performance camera and a high-performance signal processing system, by analyzing the user's golf posture and driver swing speed based on the sensed signal of a sensor unit where a plurality of sensors are arranged one-dimensionally or two-dimensionally on a mat plate.

FIGS. 2 to 9 are diagrams for describing a sensor arrangement structure of a sensor unit of FIG. 1.

As shown in FIGS. 2 to 9, in a sensor unit according to an embodiment of the inventive concept, a plurality of sensors may be arranged one-dimensionally or two-dimensionally on a mat plate.

Here, each of the plurality of sensors may be a single sensor including one of a capacitive pressure sensor, a resistive pressure sensor, and a hybrid pressure sensor; alternatively, each of the plurality of sensors may be a composite sensor including two or more among the capacitive pressure sensor, the resistive pressure sensor, and the hybrid pressure sensor.

As illustrated in FIGS. 2 to 5, in the sensor unit according to an embodiment of the inventive concept, single sensors 160, each of which includes one of the capacitive pressure sensor, the resistive pressure sensor, and the hybrid pressure sensor, may be arranged one-dimensionally or two-dimensionally on a mat plate 150.

For example, the capacitance of the capacitive pressure sensor may be changed depending on a distance from a driver and the user's pressure; the resistance of the resistive pressure sensor may be changed depending on the distance from the driver and the user's pressure; and, the capacitance and resistance of the hybrid pressure sensor may be changed depending on the distance from the driver and the user's pressure.

Figure 2:
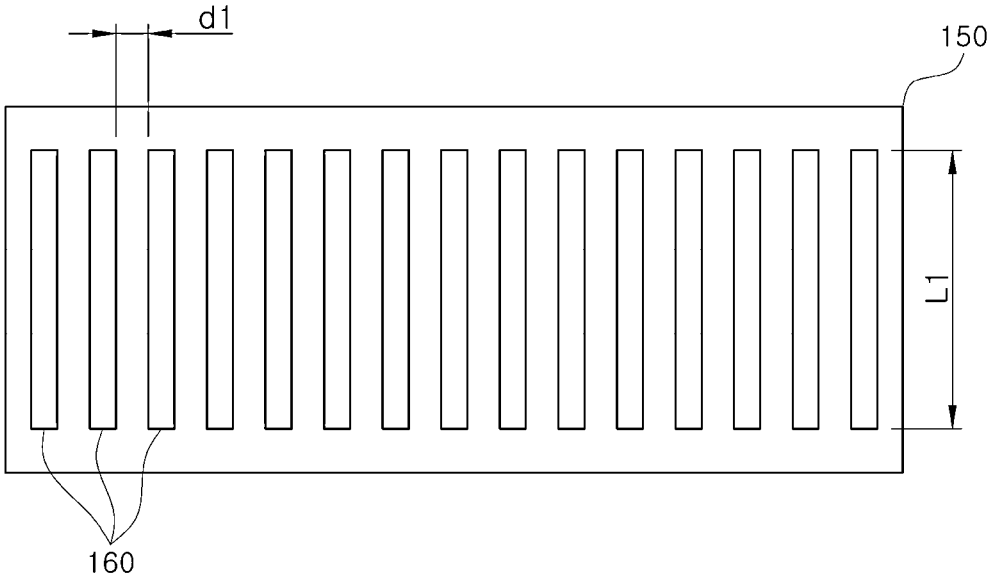
FIGS. 2 to 9 are diagrams for describing a sensor arrangement structure of a sensor unit of FIG. 1.

The single sensors 160 of FIG. 2 may be arranged one-dimensionally in a form of a bar on the mat plate 150 and may be arranged at an equal interval d1 in the lateral direction of the mat plate 150 while each of the single sensors 160 of FIG. 2 has the same length L1.

Figure 3:
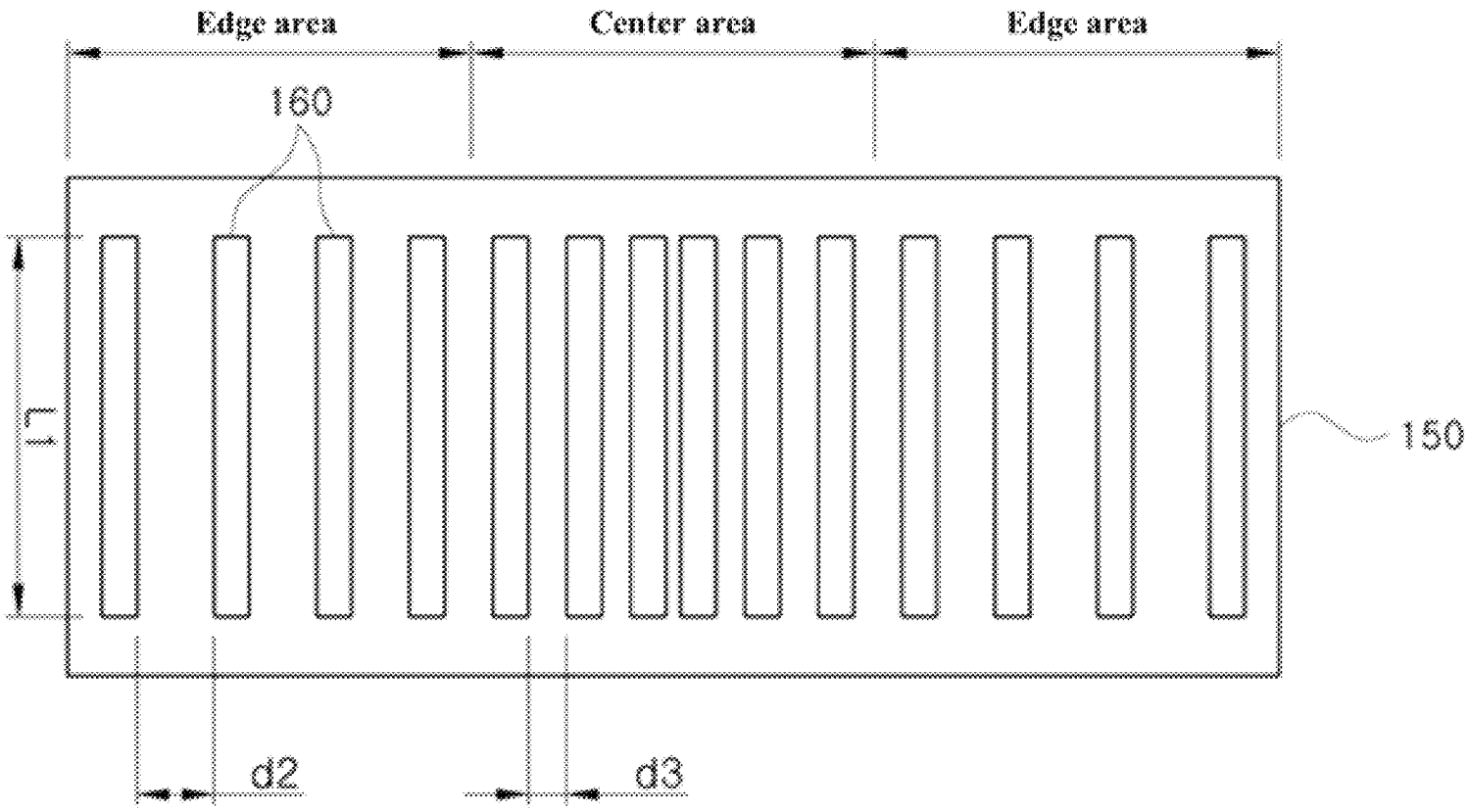

In some cases, the single sensors 160 of FIG. 3 may be arranged one-dimensionally in a form of a bar on the mat plate 150 and may be arranged at unequal intervals in the lateral direction of the mat plate 150.

Here, the single sensors 160 arranged in the lateral direction may be arranged such that an interval between the single sensors gradually narrows from one side of the mat plate to a center area of the mat plate and then gradually widens from the center area to the other side.

That is, in the single sensors 160 arranged in the lateral direction, an interval d3 between sensors located in the center area may be narrower than an interval d2 between sensors located in the edge area.

Figure 4:
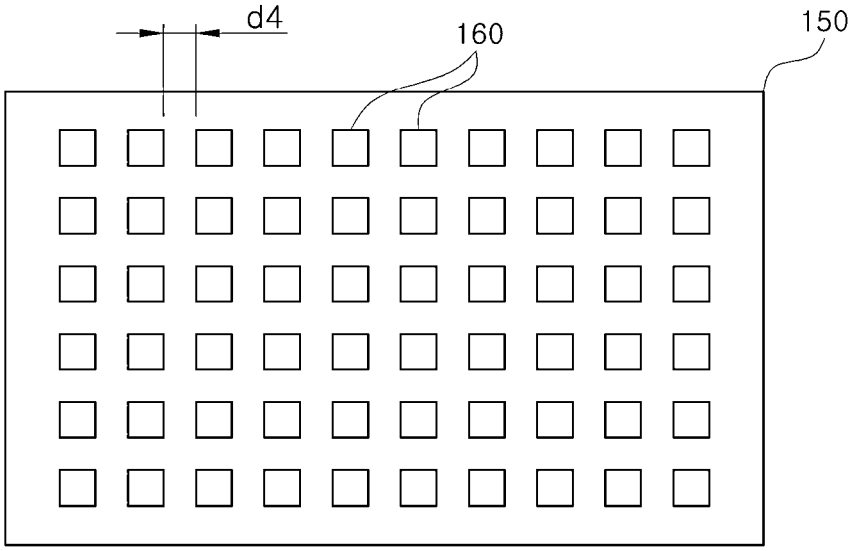

Also, the single sensors 160 of FIG. 4 may be arranged two-dimensionally in a form of a dot on the mat plate 150 and may be arranged at an equal interval d4 in lateral and longitudinal directions of the mat plate 150 while each of the single sensors 160 of FIG. 4 has the same length.

Figure 5:
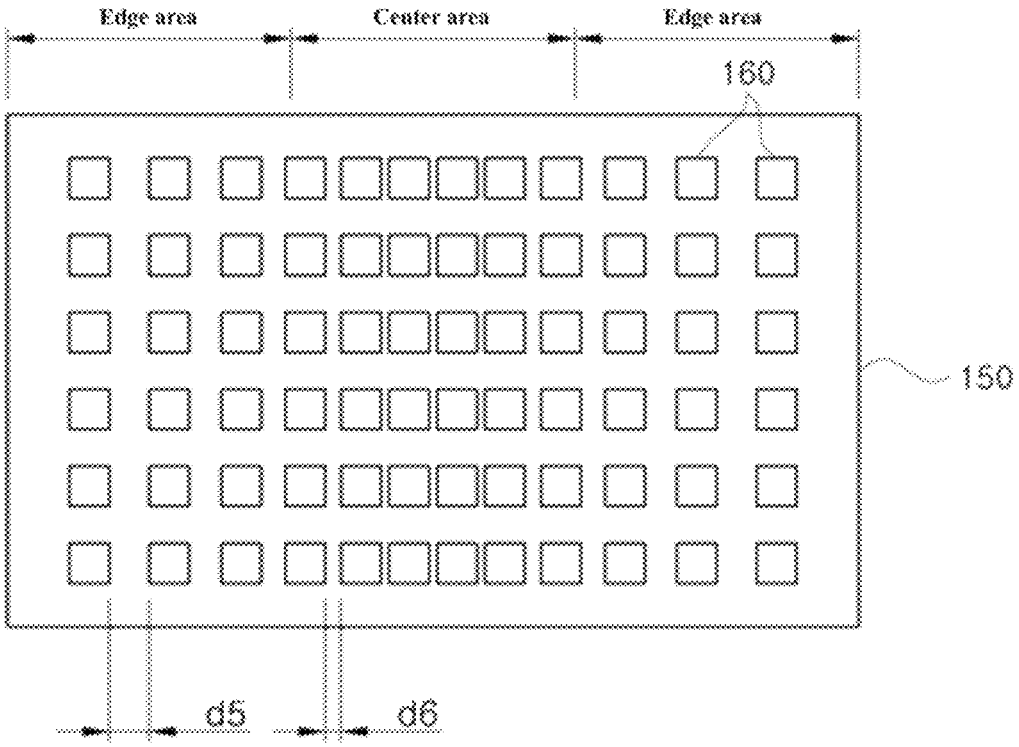

In some cases, the single sensors 160 of FIG. 5 may be arranged two-dimensionally in a form of a dot on the mat plate 150, may be arranged at unequal intervals in the lateral direction of the mat plate 150, and may be arranged at equal intervals in the longitudinal direction of the mat plate 150.

Here, the single sensors 160 arranged in the lateral direction may be arranged such that an interval between the single sensors gradually narrows from one side of the mat plate to a center area of the mat plate and then gradually widens from the center area to the other side.

That is, in the single sensors 160 arranged in the lateral direction, an interval d6 between sensors located in the center area may be narrower than an interval d5 between sensors located in the edge area.

As illustrated in FIGS. 6 to 9, in the sensor unit according to an embodiment of the inventive concept, a first sensor group 170 including a plurality of capacitive pressure sensors 172 and a second sensor group 180 including a plurality of resistive pressure sensors 182 may be arranged one-dimensionally on the mat plate 150. Alternatively, the first sensor group 170 including the plurality of capacitive pressure sensors 172 and the second sensor group 180 including the plurality of resistive pressure sensors 182 may be arranged two-dimensionally on the mat plate 150.

Here, the capacitive pressure sensors 172 of the first sensor group 170 are arranged at an upper portion of the mat plate 150 to sense the trajectory of a driver head. The resistive pressure sensors 182 of the second sensor group 180 are arranged at a lower portion of the mat plate 150 to sense a pressure corresponding to the user's golf posture.

Figure 6:
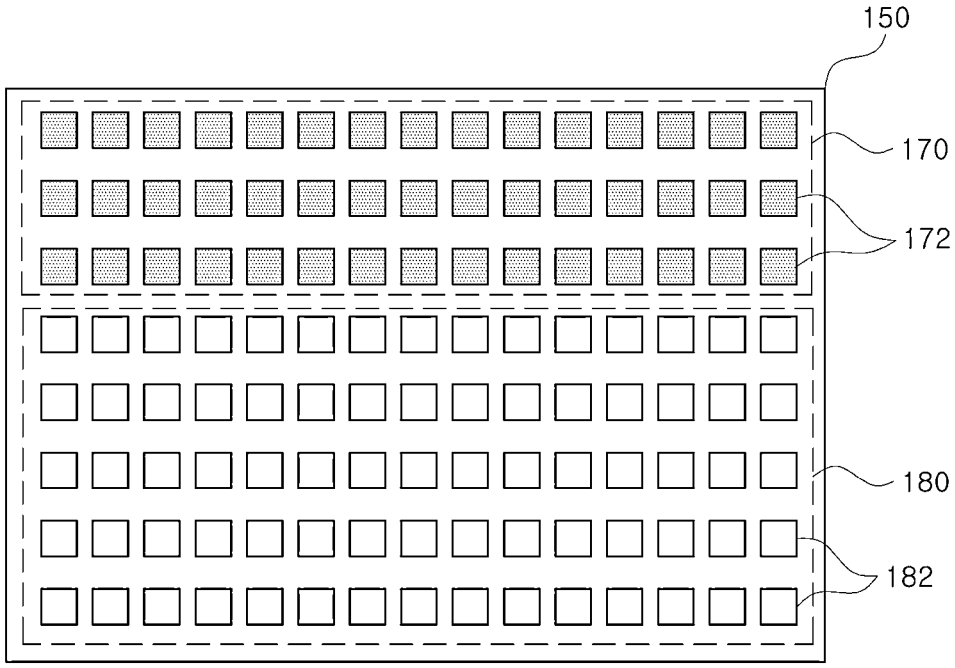

As shown in FIG. 6, the capacitive pressure sensors 172 of the first sensor group 170 may be arranged at equal intervals in the lateral direction and the longitudinal direction at the upper portion of the mat plate 150. The resistive pressure sensors 182 of the second sensor group 180 may be arranged at equal intervals in the lateral direction and the longitudinal direction at the lower portion of the mat plate 150.

Here, an interval between the capacitive pressure sensors 172 arranged in the lateral direction may be the same as an interval between the resistive pressure sensors 182 arranged in the lateral direction. An interval between the capacitive pressure sensors 172 arranged in the longitudinal direction may be the same as an interval between the resistive pressure sensors 182 arranged in the longitudinal direction.

Figure 7:
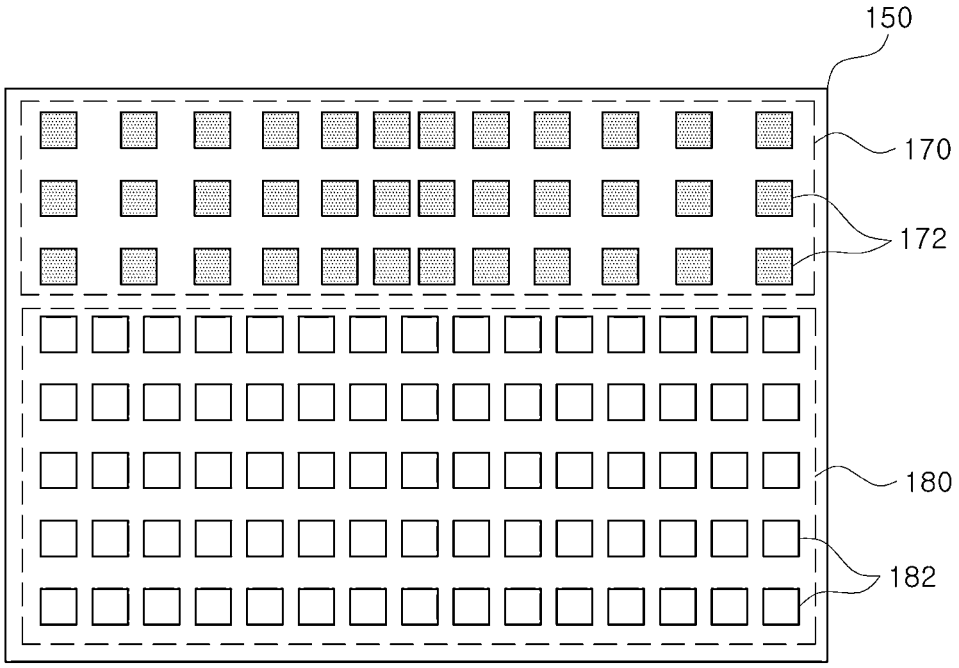

In some cases, as shown in FIG. 7, the capacitive pressure sensors 172 of the first sensor group 170 may be arranged at unequal intervals in the lateral direction at the upper portion of the mat plate 150 and may be arranged at equal intervals in the longitudinal direction at the upper portion of the mat plate 150. The resistive pressure sensors 182 of the second sensor group 180 may be arranged at equal intervals in the lateral direction and the longitudinal direction at the lower portion of the mat plate 150.

Here, an interval between the capacitive pressure sensors 172 arranged in the lateral direction may be different from an interval between the resistive pressure sensors 182 arranged in the lateral direction. An interval between the capacitive pressure sensors 172 arranged in the longitudinal direction may be the same as an interval between the resistive pressure sensors 182 arranged in the longitudinal direction.

For example, the capacitive pressure sensors 172 arranged in the lateral direction may be arranged such that an interval between the capacitive pressure sensors 172 gradually narrows from one side of the upper portion of the mat plate 150 to a center area of the upper portion of the mat plate and then gradually widens from the center area to the other side.

Moreover, the number of capacitive pressure sensors 172 of the first sensor group 170 may be less than the number of resistive pressure sensors 182 of the second sensor group 180.

The number of capacitive pressure sensors in the first sensor group that measures the driver's speed is not needed to be greater than the number of resistive pressure sensors in the second sensor group that measures a user's golf posture. This is to make a mat compact such that the user is capable of conveniently transporting the mat, by minimizing the size of the mat by using the smallest sensor.

Figure 8:
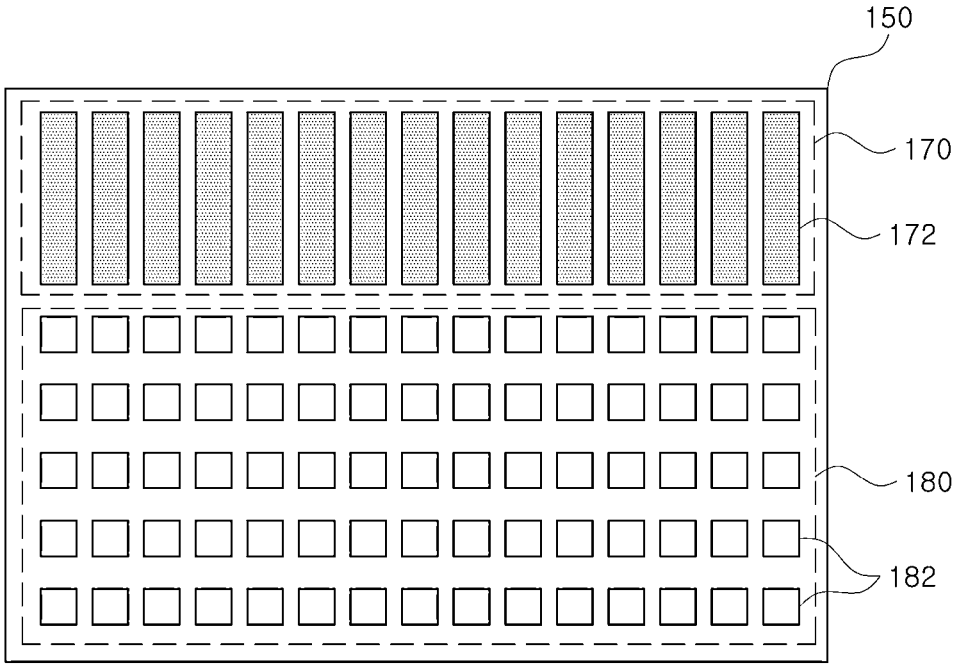
Figure 9:
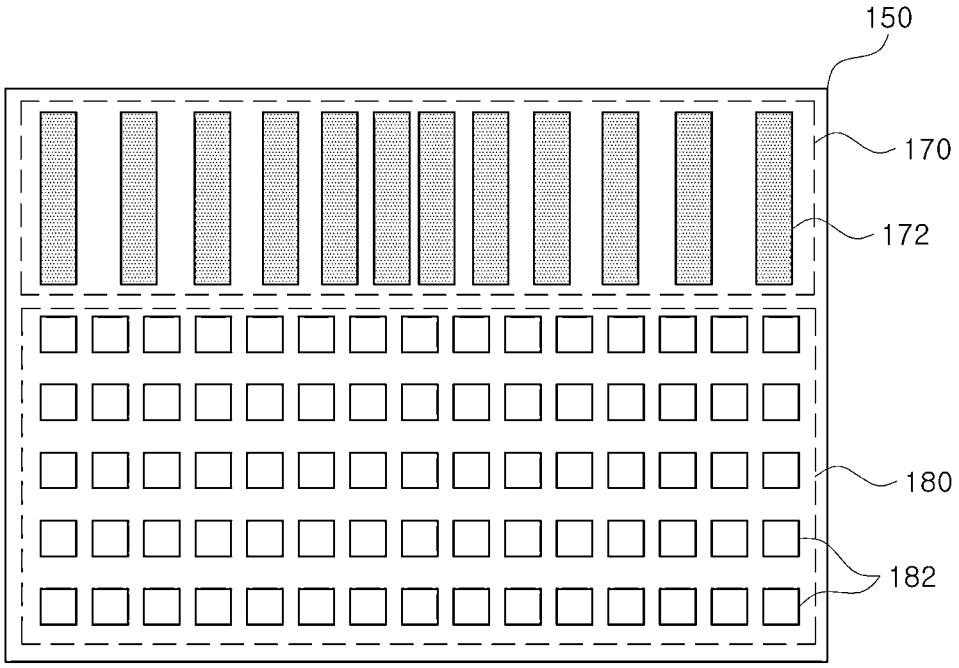

Furthermore, as illustrated in FIGS. 8 and 9, in the sensor unit, the first sensor group 170 including the plurality of capacitive pressure sensors 172 may be arranged one-dimensionally on the mat plate 150. The second sensor group 180 including the plurality of resistive pressure sensors 182 may be arranged two-dimensionally on the mat plate 150.

Here, the capacitive pressure sensors 172 of the first sensor group 170 are arranged at an upper portion of the mat plate 150 to sense the trajectory of a driver head. The resistive pressure sensors 182 of the second sensor group 180 are arranged at a lower portion of the mat plate 150 to sense a pressure corresponding to the user's golf posture.

Moreover, as shown in FIG. 8, the capacitive pressure sensors 172 of the first sensor group 170 may be arranged at equal intervals in the lateral direction at the upper portion of the mat plate 150. The resistive pressure sensors 182 of the second sensor group 180 may be arranged at equal intervals in the lateral direction and the longitudinal direction at the lower portion of the mat plate 150.

Here, an interval between the capacitive pressure sensors 172 arranged in the lateral direction may be the same as an interval between the resistive pressure sensors 182 arranged in the lateral direction.

In some cases, as shown in FIG. 9, the capacitive pressure sensors 172 of the first sensor group 170 may be arranged at unequal intervals in the lateral direction at the upper portion of the mat plate 150. The resistive pressure sensors 182 of the second sensor group 180 may be arranged at equal intervals in the lateral direction and the longitudinal direction at the lower portion of the mat plate 150.

Here, an interval between the capacitive pressure sensors 172 arranged in the lateral direction may be different from an interval between the resistive pressure sensors 182 arranged in the lateral direction.

At this time, the capacitive pressure sensors 172 arranged in the lateral direction may be arranged such that an interval between the capacitive pressure sensors 172 gradually narrows from one side of the upper portion of the mat plate 150 to a center area of the upper portion of the mat plate and then gradually widens from the center area to the other side.

Moreover, the number of capacitive pressure sensors 172 of the first sensor group 170 may be less than the number of resistive pressure sensors 182 of the second sensor group 180.

In some cases, although not illustrated, in the sensor unit, the first sensor group 170 including the plurality of capacitive pressure sensors 172 may be arranged two-dimensionally on the mat plate 150. The second sensor group 180 including the plurality of resistive pressure sensors 182 may be arranged one-dimensionally on the mat plate 150.

For example, the capacitance of the capacitive pressure sensor of the sensor unit may be changed depending on a distance from a driver and the user's pressure; the resistance of the resistive pressure sensor of the sensor unit may be changed depending on the distance from the driver and the user's pressure; and, the capacitance and resistance of the hybrid pressure sensor of the sensor unit may be changed depending on the distance from the driver and the user's pressure.

FIGS. 10 to 13 are diagrams for describing a sensor structure of a sensor unit of FIG. 1.

As shown in FIGS. 10 to 13, in a sensor unit according to an embodiment of the inventive concept, a plurality of sensors may be arranged one-dimensionally or two-dimensionally on a mat plate.

Here, each of the plurality of sensors may be a single sensor including one of a capacitive pressure sensor, a resistive pressure sensor, and a hybrid pressure sensor; alternatively, each of the plurality of sensors may be a composite sensor including two or more among the capacitive pressure sensor, the resistive pressure sensor, and the hybrid pressure sensor.

Figure 10:
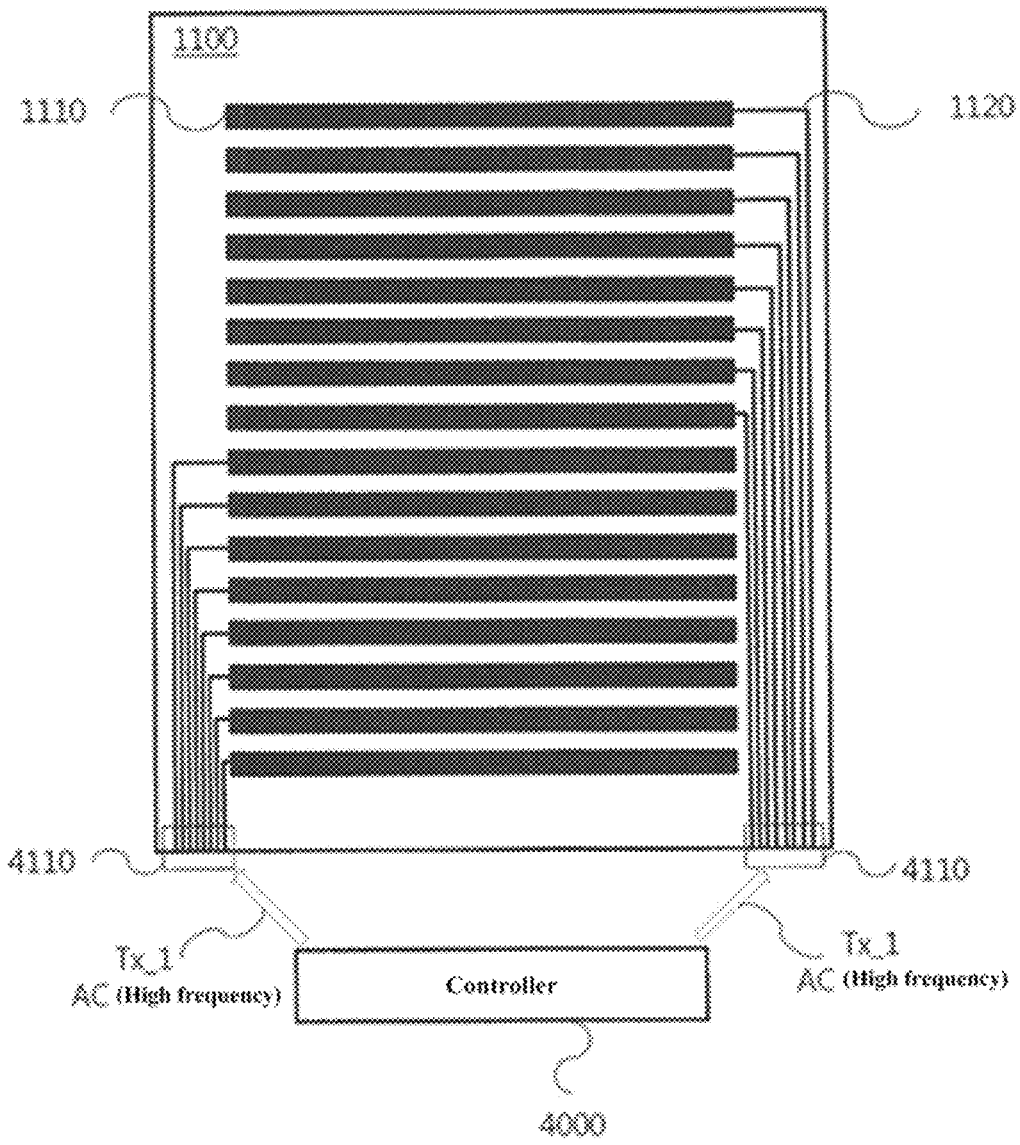
FIGS. 10 to 13 are diagrams for describing a sensor structure of a sensor unit of FIG. 1.

As illustrated in FIG. 10, a sensor according to an embodiment of the inventive concept may have a first electrode pattern 1100.

Here, the first electrode pattern 1100 may include a plurality of first conductive lines 1110 and a plurality of wirings 1120 connecting the first conductive lines 1110 to a controller 4000.

The first electrode pattern 1100 may include the plurality of first conductive lines 1110 that are spaced from one another and extend in one direction in parallel.

Moreover, the first electrode pattern 1100 may include the wirings 1120 connecting the plurality of first conductive lines 1110 to a first connection part 4110. The wirings 1120 may be connected to the controller 4000 through the first connection unit 4110.

Besides, a part of the plurality of wirings 1120 for transmitting a first driving signal received from the controller 4000 to the first conductive line 1110 may be positioned on a first bezel in the first electrode pattern 1100. The remaining parts thereof may be positioned on a second bezel in the first electrode pattern 1100.

Next, the controller 4000 may transmit a plurality of electrical signals Tx_1 to the plurality of first conductive lines 1110.

Figure 11:
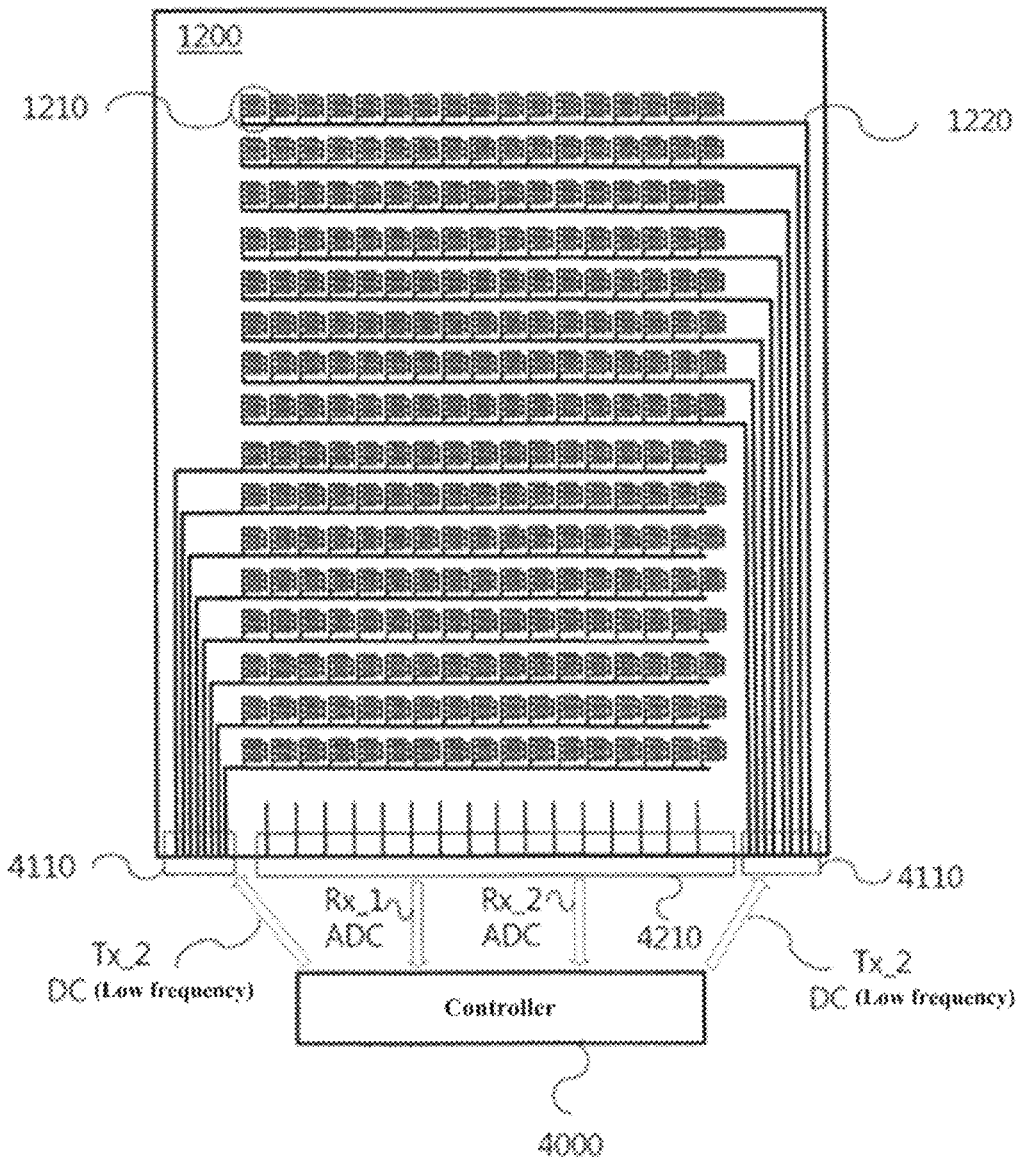
Figure 12:
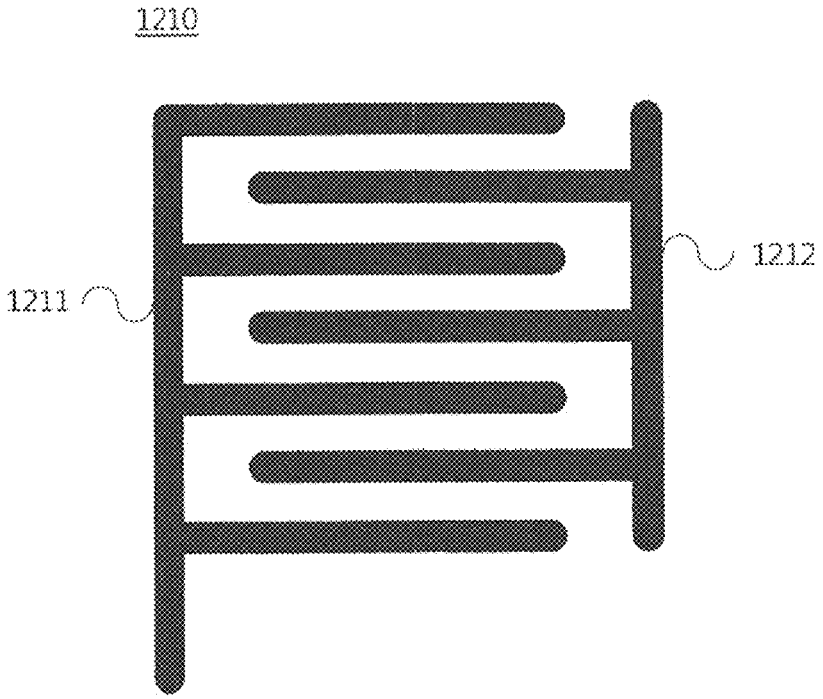

In some cases, as illustrated in FIGS. 11 and 12, a sensor according to an embodiment of the inventive concept may have a first electrode pattern 1200.

Here, the second electrode pattern 1200 may include a plurality of second conductive lines 1211, a plurality of third conductive lines 1212, a plurality of wirings 1220, a part of a plurality of wirings 1220 connecting the second conductive lines 1211 to the controller 4000, and the remaining parts of the plurality of wirings 1220 connecting the third conductive lines 1212 to the controller 4000.

The plurality of wirings 1220 connecting the third conductive line 1212 to the controller 4000 may be positioned on the second electrode pattern 1200.

The second electrode pattern 1200 may include the second conductive lines 1211 and the third conductive lines 1212, which are spaced from each other and positioned in a complementary shape.

Here, a part of the second conductive lines 1211 and a part of the third conductive lines 1212 may form a complementary shape. The complementary shape may have a predetermined unit area of the second electrode pattern 1200 and a predetermined unit area of a third electrode pattern 2100, and may be a part of the one unit sensing cell 1210.

The number of sensing cells 1210 may be determined by the number of second conductive lines 1211 and the number of third conductive lines 1212.

For example, when the number of second conductive lines 1211 is N and the number of third conductive lines 1212 is M, the number of sensing cells 1210 is "N*M".

Moreover, the second electrode pattern 1200 may include a part of the wirings 1220 for connecting the plurality of second conductive lines 1211 to the first connection part 4110 and the remaining parts of the wirings 1220 for connecting the plurality of third conductive lines 1212 to a second connection part 4210.

Here, the wirings 1220 may be connected to the controller 4000 through the first connection part 4110 and the second connection part 4210.

Also, a part of the plurality of wirings 1220 for transmitting a second driving signal received from the controller 4000 to the second conductive line 1211 may be positioned on a first bezel in the second electrode pattern 1200. The remaining parts thereof may be positioned on a second bezel in the second electrode pattern 1200.

Moreover, the controller 4000 may transmit a plurality of electrical signals Tx_2 to the plurality of second conductive lines 1211.

Furthermore, the controller 4000 may receive a plurality of electrical signals Rx_1 or Rx_2 to the plurality of third conductive lines 1212.

Here, to detect a capacitance change from the plurality of third conductive lines 1212 and to detect a first sensed signal (an analog digital converter (ADC)) corresponding to a first driving signal and a resistance change, the controller 4000 may receive a second sensed signal (ADC) corresponding to a second driving signal from the second electrode pattern 1200.

Figure 13:
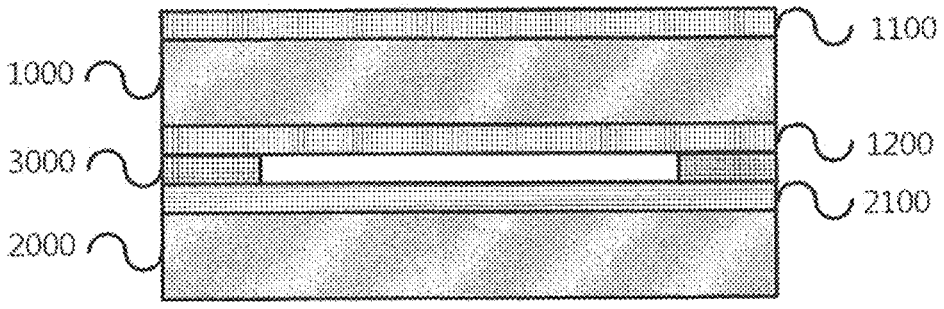

As another example, as shown in FIG. 13, a sensor according to an embodiment of the inventive concept may be a hybrid pressure sensor in which a capacitive sensor and a resistive sensor are integrated with each other.

Here, the hybrid pressure sensor may include a first sheet 1000, a second sheet 2000, a spacer layer 3000, the first electrode pattern 1100, the second electrode pattern 1200, and the third electrode pattern 2100.

The first electrode pattern 1100 may be formed on one surface of the first sheet 1000; the second electrode pattern 1200 may be formed on the other surface opposite to the first electrode pattern 1100 of the first sheet 1000; and, the third electrode pattern 2100 may be formed on one surface opposite to the second electrode pattern 1200 of the second sheet 2000.

Then, the spacer layer 3000 may be positioned between the first sheet 1000 and the second sheet 2000 such that the second electrode pattern 1200 and the third electrode pattern 2100 are spaced from each other by a predetermined distance.

In addition, a part of the first electrode pattern 1100, a predetermined unit area of the second electrode pattern 1200, and a predetermined unit area of the third electrode pattern 2100 may form one unit sensing cell. The unit sensing cell may include a capacitive sensing cell and a resistive sensing cell.

For example, the sensing cell may be a group of patterns in which one conductive line in the first electrode pattern 1100, a pattern having a complementary shape in the second electrode pattern 1200, and one conductive island pattern in the third electrode pattern 2100 are positioned vertically at the same location.

Next, the first sheet 1000, the second sheet 2000, and the spacer layer 3000 may be attached to one another by an adhesive layer.

In some cases, a buffer layer for preventing the adhesive layer from being torn may be further included between the adhesive layer and each of the first sheet 1000, the second sheet 2000, and the spacer layer 3000.

Here, to overcome a difference in physical properties of the first sheet 1000, the second sheet 2000, and the spacer layer 3000, the buffer layer has a function to prevent the adhesive layer from being torn.

For example, in a high-temperature or high-humidity environment, or in a state where each sheet is bent or twisted after the first sheet 1000, the second sheet 2000 and the spacer layer 3000 are attached to each other, the adhesive layer may fall off due to a difference in the physical properties of sheets.

The buffer layer may prevent the adhesive layer from being torn by compensating for the difference in physical properties of the first sheet 1000, the second sheet 2000, and the spacer layer 3000.

For example, the buffer layer may be a substance, which is made of a flexible material so as to be stretched due to tensile force when the first sheet 1000, the second sheet 2000, and the spacer layer 3000 are bent or twisted and which is restored to its original shape when the first sheet 1000, the second sheet 2000, and the spacer layer 3000 are restored after being bent or twisted.

In addition, an upper surface of the first electrode pattern 1100 may further include a protective film.

When the upper surface of the first electrode pattern 1100 is exposed on the outside, moisture may corrode the first electrode pattern 1100 and the first electrode pattern 1100 may be contaminated by foreign substances or may be torn. The protective film for preventing the first electrode pattern 1100 from being torn may be attached to the upper surface of the first electrode pattern 1100.

In some cases, the upper surface of the first electrode pattern 1100 may further include a light emitting film.

For example, the inventive concept may include a light emitting film that may appropriately emit light depending on the movement of a user, and thus the user may identify accurate information in real time and may feel interest during exercise.

For example, in a golf swing posture, the light emitting film may emit light near a left sole when more force is applied to a left sole.

Figure 14:
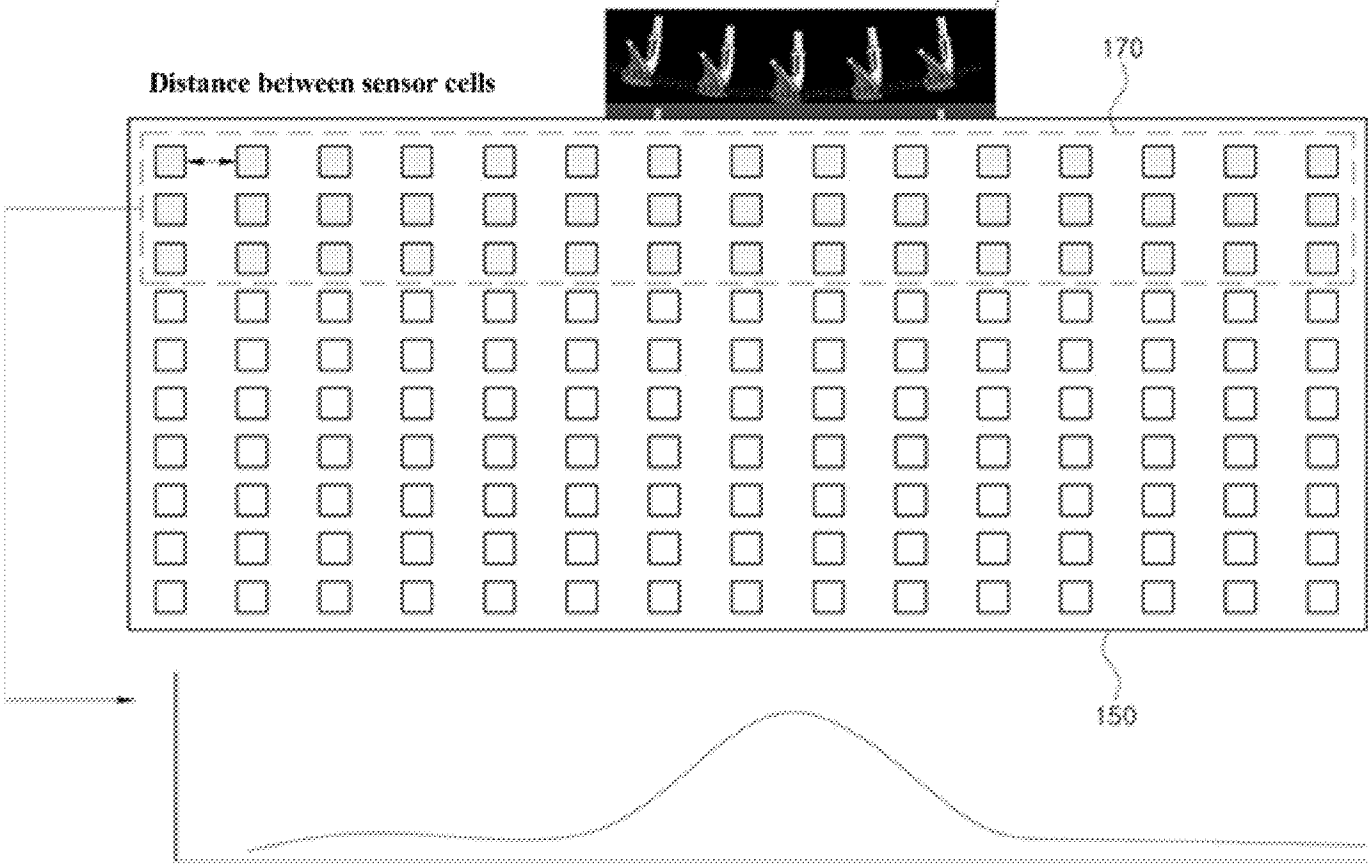
FIGS. 14 and 15 are diagrams illustrating a capacitance change according to proximity of a golf club head.
Figure 15:
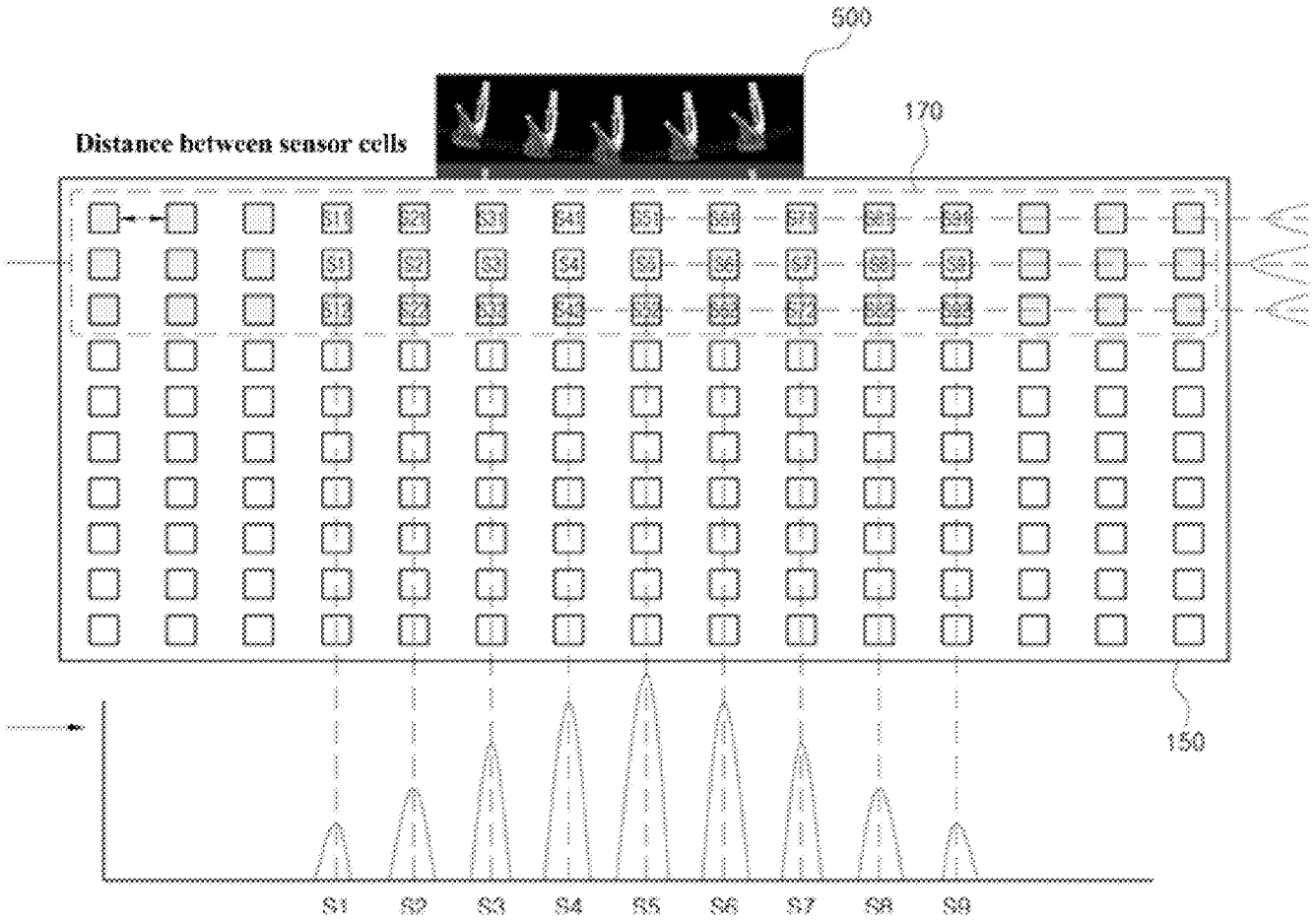

FIGS. 14 and 15 are diagrams illustrating a capacitance change according to proximity of a golf club head.

As shown in FIGS. 14 and 15, according to an embodiment of the inventive concept, capacitive pressure sensors of the first sensor group 170 may be arranged at the upper portion of the mat plate 150 to sense the trajectory of a club head 500.

The capacitance of each of the capacitive pressure sensors may be changed depending on a distance from the club head 500.

In other words, in the capacitive pressure sensors, as the distance to the club head 500 decreases, the signal strength of capacitance may increase; and, as the distance from the club head 500 increases, the signal strength of capacitance may decrease.

Accordingly, the inventive concept may analyze the user's golf posture and club swing speed based on the sensed signal of the sensor that senses the pressure corresponding to the user's golf posture and the trajectory of the club head 500.

After receiving the user's body information, the inventive concept may determine whether the sensed signal of the sensor corresponds to a location of a golf ball. When the sensed signal corresponds to the location of the golf ball, the inventive concept may determine a tee location based on the location of the golf ball.

Moreover, the inventive concept may determine whether the sensed signal corresponds to the user's plantar pressure and the location of a club head. When the sensed signal corresponds to the user's plantar pressure and the location of the club head, the inventive concept may calculate the user's pressure center point from the plantar pressure and may determine an address posture based on the user's pressure center point and the location of the club head.

Furthermore, the inventive concept may determine whether the sensed signal corresponds to the user's golf posture change that corresponds to a change in the user's plantar pressure, a change in the pressure center point, and a change in a center-of-gravity. When the sensed signal corresponds to the user's golf posture change, the inventive concept may determine the user's swing based on the change in the user's plantar pressure, the change in the pressure center point, and the change in the center-of-gravity.

Also, the inventive concept may determine that a point in time when a club head deviates from a mat plate based on the start point of the swing is a point in time when a backswing is entered, based on the sensed signal. The inventive concept may calculate the user's backswing speed based on a speed and a time from the start point of the swing to a point in time when the golf club head deviates from the mat plate.

Besides, the inventive concept may measure a time required for the club head to enter the mat plate and then to pass through the start point of the swing, from the sensed signal of a sensor and then may calculate the speed of the club head based on the measured time.

In addition, the inventive concept may measure a time, which is required for the club head to leave the mat plate from the start point of the swing and then to return to the start point of the swing, from the sensed signal of the sensor; and, the inventive concept may calculate a time from the start of the swing to an impact based on the measured time.

Figure 16:
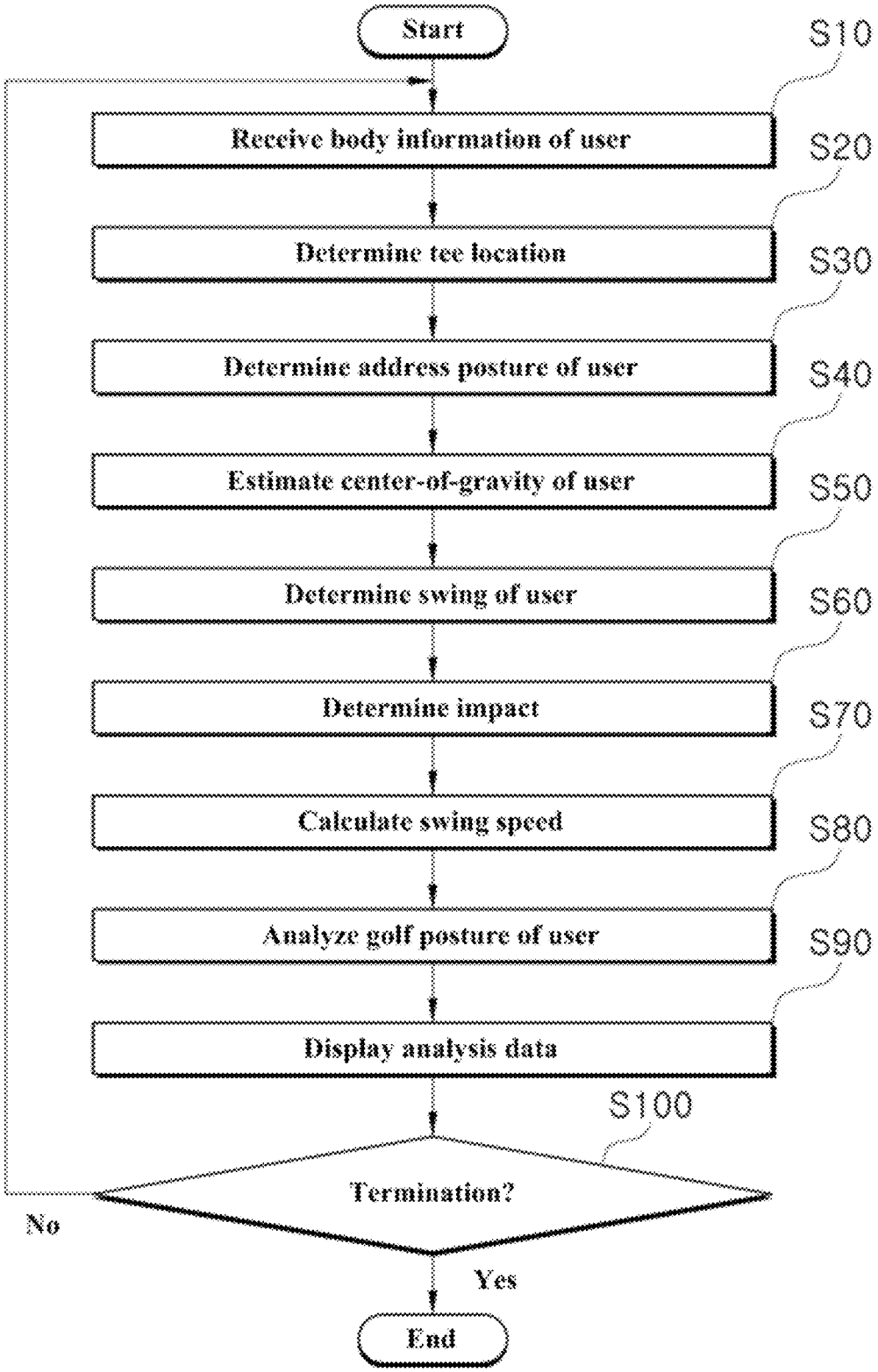
FIG. 16 is a flowchart for describing a method of measuring a golf club speed and a golf posture, according to an embodiment of the inventive concept.

FIG. 16 is a flowchart for describing a method of measuring a golf club speed and a golf posture, according to an embodiment of the inventive concept.

As shown in FIG. 16, when receiving body information of a user, the inventive concept may store the body information of the user (S10).

Furthermore, the inventive concept may determine a tee location by analyzing a location of a golf ball based on the sensed signal of a sensor (S20).

Here, the inventive concept may determine whether the sensed signal of the sensor corresponds to a location of a golf ball, by processing the sensed signal of a sensor. When the sensed signal corresponds to the location of the golf ball, the inventive concept may determine the tee location based on the location of the golf ball.

Next, the inventive concept may determine an address posture by analyzing the user's pressure center point and the location of the head of a predetermined golf club (S30).

Here, the inventive concept may determine whether the sensed signal corresponds to the user's plantar pressure and the location of a golf club head, by processing the sensed signal of the sensor. When the sensed signal corresponds to the user's plantar pressure and the location of the golf club head, the inventive concept may calculate the user's pressure center point from the plantar pressure and may determine an address posture based on the user's pressure center point and the location of the golf club head.

Next, the inventive concept may estimate the user's center-of-gravity by reflecting the user's pressure center point and the received user's body information (S40).

Here, the inventive concept may determine whether the received body information of the user is stored in advance. When the pre-stored body information of the user is present, the inventive concept may estimate the user's center-of-gravity based on the user's pressure center point and body information.

In some cases, when the user's body information stored in advance is not present, the inventive concept may display an input request message for the user's body information or may display a notification that the user's body information is not present.

Moreover, the inventive concept may determine a swing by reflecting a change in the user's plantar pressure, pressure center point, and center-of-gravity corresponding to the user's golf posture change (S50).

Here, the inventive concept may determine whether the sensed signal corresponds to the user's golf posture change corresponding to a change in the user's plantar pressure, a change in the pressure center point, and a change in the center-of-gravity, by processing the sensed signal of the sensor. When the sensed signal corresponds to the user's golf posture change, the inventive concept may determine the user's swing based on a change in the user's plantar pressure, a change in the pressure center point, and a change in the center-of-gravity.

Next, the inventive concept may determine an impact corresponding to a weight change of the tee location (S60).

Next, the inventive concept may calculate a swing speed of a golf club before and after the impact (S70).

Moreover, the inventive concept may analyze the user's golf posture by comparing the change in the user's plantar pressure, pressure center point, and center-of-gravity corresponding to the user's golf posture change with reference data (S80).

Then, the inventive concept may allow analysis data including the analyzed golf posture of the user and golf club swing speed of the user to be displayed (S90).

Next, the inventive concept may determine whether there is a measurement termination request (S100). When there is a measurement termination request, the inventive concept may terminate the subsequent measurement process.

As such, in an embodiment of the inventive concept, it is possible to measure a driver speed and a golf posture accurately, easily, and inexpensively in a simple way without a high-performance camera and a high-performance signal processing system, by analyzing the user's golf posture and a swing speed of a golf club based on the sensed signal of a sensor unit where a plurality of sensors are arranged one-dimensionally or two-dimensionally on a mat plate.

The method according to an embodiment of the inventive concept may be implemented by a program (or an application) and may be stored in a medium such that the program is executed in combination with a server being hardware.

The above-described program may include a code encoded by using a computer language such as C, C++, JAVA, a machine language, or the like, which a processor (CPU) of the computer may read through the device interface of the computer, such that the computer reads the program and performs the methods implemented with the program. The code may include a functional code related to a function that defines necessary functions executing the method, and the functions may include an execution procedure related control code necessary for the processor of the computer to execute the functions in its procedures. Furthermore, the code may further include a memory reference related code on which location (address) of an internal or external memory of the computer should be referenced by the media or additional information necessary for the processor of the computer to execute the functions. Further, when the processor of the computer is required to perform communication with another computer or a server in a remote site to allow the processor of the computer to execute the functions, the code may further include a communication related code on how the processor of the computer executes communication with another computer or the server or which information or medium should be transmitted/received during communication by using a communication module of the computer.

The stored medium refers not to a medium, such as a register, a cache, or a memory, which stores data for a short time but to a medium that stores data semi-permanently and is read by a device. Specifically, for example, the stored media include, but are not limited to, ROM, RAM, CD-ROM, magnetic tape, floppy disk, optical data storage device, and the like. That is, the program may be stored in various recording media on various servers, which the computer may access, or in various recording media on the computer of the user. Further, the media may be distributed in computer systems connected over a network such that codes readable by the computer are stored in a distributed manner.

Steps or operations of the method or algorithm described with regard to an embodiment of the inventive concept may be implemented directly in hardware, may be implemented with a software module executable by hardware, or may be implemented by a combination thereof. The software module may reside in a random access memory (RAM), a read only memory (ROM), an erasable programmable ROM (EPROM), an electrically erasable programmable ROM (EEPROM), a flash memory, a hard disk, a removable disk, a CD-ROM, or a computer-readable recording medium well known in the art to which the inventive concept pertains.

Although an embodiment of the inventive concept are described with reference to the accompanying drawings, it will be understood by those skilled in the art to which the inventive concept pertains that the inventive concept may be carried out in other detailed forms without changing the scope and spirit or the essential features of the inventive concept. Therefore, the embodiments described above are provided by way of example in all aspects, and should be construed not to be restrictive.

The invention claimed is:

1. A golf posture measuring mat capable of measuring a speed of a golf club, the golf posture measuring mat comprising:

a sensor unit configured to sense a pressure corresponding to a golf posture of a user and a predetermined trajectory of a head of a golf club;

a control unit configured to analyze the golf posture of the user and a swing speed of the golf club based on a sensed signal of the sensor unit;

a display unit configured to display analysis data analyzed by the control unit; and a storage unit configured to store the analysis data and reference data, wherein a plurality of sensors in the sensor unit are arranged one-dimensionally or two-dimensionally on a mat plate, wherein each of the plurality of sensors includes a single sensor including one among a capacitive pressure sensor, a resistive pressure sensor, and a hybrid pressure sensor, or includes a composite sensor including two or more among the capacitive pressure sensor, the resistive pressure sensor, and the hybrid pressure sensor, and wherein the control unit is configured to:

determine a tee location by analyzing a location of a golf ball based on the sensed signal of the sensor unit when receiving body information of the user;

determine an address posture by analyzing a pressure center point of the user and a location of the head of the golf club;

estimate a center-of-gravity of the user by reflecting the pressure center point of the user and the received body information of the user;

determine a swing by reflecting a change in a plantar pressure of the user, the pressure center point of the user, and the center-of-gravity of the user corresponding to a change in the golf posture of the user;

determine an impact corresponding to a weight change of the tee location;

calculate the swing speed of the golf club before and after the impact;

analyze the golf posture of the user by comparing a change in the plantar pressure of the user, a change in the pressure center point of the user, and a change in the center-of-gravity of the user corresponding to the change in the golf posture of the user with the reference data; and control the display unit so as to display the analysis data including the analyzed golf posture of the user and the swing speed of the golf club.

2. The golf posture measuring mat of claim 1, wherein, in the sensor unit, single sensors, each of which includes one of the capacitive pressure sensor, the resistive pressure sensor, and the hybrid pressure sensor, are arranged one-dimensionally or two-dimensionally on the mat plate.

3. The golf posture measuring mat of claim 1, wherein, in the sensor unit, a first sensor group including a plurality of capacitive pressure sensors and a second sensor group including a plurality of resistive pressure sensors are arranged one-dimensionally on the mat plate, or wherein, in the sensor unit, the first sensor group including the plurality of capacitive pressure sensors and the second sensor group including the plurality of resistive pressure sensors are arranged two-dimensionally on the mat plate.

4. The golf posture measuring mat of claim 3, wherein the capacitive pressure sensors of the first sensor group are arranged at an upper portion of the mat plate so as to sense a trajectory of the head of the golf club, and wherein the resistive pressure sensors of the second sensor group are arranged at a lower portion of the mat plate so as to sense the pressure corresponding to the golf posture of the user.

5. The golf posture measuring mat of claim 4, wherein the capacitive pressure sensors of the first sensor group are arranged at unequal intervals at the upper portion of the mat plate in a lateral direction and arranged at equal intervals at the upper portion of the mat plate in a longitudinal direction, and wherein the resistive pressure sensors of the second sensor group are arranged at equal intervals at the lower portion of the mat plate in the lateral direction and the longitudinal direction.

6. The golf posture measuring mat of claim 1, wherein, in the sensor unit, a first sensor group including a plurality of capacitive pressure sensors is arranged one-dimensionally on the mat plate, and a second sensor group including a plurality of resistive pressure sensors is arranged two-dimensionally on the mat plate, or wherein the first sensor group including the plurality of capacitive pressure sensors is arranged two-dimensionally on the mat plate, and the second sensor group including the plurality of resistive pressure sensors is arranged one-dimensionally on the mat plate.

7. The golf posture measuring mat of claim 1, wherein the control unit is configured to:

when determining the address posture, determine whether the sensed signal corresponds to the plantar pressure of the user and the location of the head of the golf club, by processing the sensed signal when the sensed signal is received from the sensor unit;

when the sensed signal corresponds to the plantar pressure of the user and the location of the head of the golf club, calculate the pressure center point of the user from the plantar pressure; and determine the address posture based on the pressure center point of the user and the location of the golf club head.

8. The golf posture measuring mat of claim 1, wherein the control unit is configured to:

when determining the swing, determine whether the sensed signal corresponds to the change in the golf posture of the user corresponding to the change in the plantar pressure of the user, the change in the pressure center point of the user, and the change in the center-of-gravity of the user, by processing the received sensed signal when the sensed signal is received from the sensor unit; and when the sensed signal corresponds to the change in the golf posture of the user, determine the swing of the user based on the change in the plantar pressure of the user, the change in the pressure center point of the user, and the change in the center-of-gravity of the user.

9. The golf posture measuring mat of claim 8, wherein the control unit is configured to:

immediately before determining the swing of the user, determine a current location of the head of the golf club as a start point of the swing.

10. The golf posture measuring mat of claim 9, wherein the control unit is configured to:

determine that a point in time when the head of the golf club deviates from the mat plate based on the start point of the swing is a point in time when a backswing is entered, based on the sensed signal; and calculate a backswing speed of the user based on a speed and a time from the start point of the swing to a point in time when the head of the golf club head deviates from the mat plate.

11. The golf posture measuring mat of claim 9, wherein the control unit is configured to:

measure a time required for the head of the golf club to enter the mat plate and then to pass through the start point of the swing, from the sensed signal; and calculate a speed of the head of the golf club based on the measured time.

12. The golf posture measuring mat of claim 1, wherein the control unit is configured to:

a signal processing unit configured to process the sensed signal received from the sensor unit;

a plantar pressure measurement unit configured to measure the change in the plantar pressure of the user corresponding to the golf posture of the user;

a pressure center point calculation unit configured to calculate the pressure center point of the user corresponding to the golf posture of the user;

a pressure center point trajectory tracking unit configured to track a movement of the calculated pressure center point of the user;

an address determination unit configured to determine the address posture by analyzing the pressure center point of the user and the location of the head of the golf club;

a center-of-gravity estimation unit configured to estimate the center-of-gravity of the user by reflecting the pressure center point of the user and the received body information of the user;

a tee location determination unit configured to determine the tee location by analyzing the location of the golf ball based on the sensed signal of the sensor unit;

an impact determination unit configured to determine an impact corresponding to the weight change of the tee location;

a capacitance measurement unit configured to measure the capacitance change corresponding to the trajectory of the head of the golf club;

a capacitance comparison unit configured to compare the capacitance change corresponding to the head of the golf club with the capacitance change stored in advance;

a swing speed calculation unit configured to calculate a swing speed of the head of the golf club based on the comparison result of the capacitance change; and a posture analysis unit configured to analyze the golf posture of the user by comparing the change in the plantar pressure of the user, the change in the pressure center point of the user, and the change in the center-of-gravity of the user corresponding to the change in the golf posture of the user with the reference data.

13. The golf posture measuring mat of claim 12, wherein the storage unit includes:

a golfer body condition storage unit configured to store the received body information of the user;

a plantar pressure recording unit configured to record the plantar pressure measured from the plantar pressure measurement unit in chronological order;

a pressure center point trajectory recording unit configured to record the pressure center point tracked from the pressure center point trajectory tracking unit;

a capacitance change recording unit configured to record the capacitance change measured from the capacitance measurement unit in chronological order;

a swing speed storage unit configured to store the swing speed of the head of the golf club calculated from the swing speed calculation unit; and a reference data storage unit configured to store the reference data for comparing the golf posture of the user.

14. A golf club speed and golf posture measuring method of a golf posture measuring mat including a control unit that analyzes a golf posture of a user and a predetermined swing speed of a golf club based on a sensed signal of a sensor unit, the method comprising:

when receiving body information of the user, determining, by the control unit, a tee location by analyzing a location of a golf ball based on the sensed signal of the sensor unit;

determining, by the control unit, an address posture by analyzing a pressure center point of the user and a location of a head of the golf club;

estimating, by the control unit, a center-of-gravity of the user by reflecting the pressure center point of the user and the received body information of the user;

determining, by the control unit, a swing by reflecting a change in the plantar pressure of the user, the pressure center point of the user, and the center-of-gravity of the user corresponding to a change in the golf posture of the user;

determining, by the control unit, an impact corresponding to a weight change of the tee location;

calculating, by the control unit, a swing speed of the golf club before and after the impact;

analyzing, by the control unit, the golf posture of the user by comparing the change in the plantar pressure of the user, the pressure center point of the user, and the center-of-gravity of the user corresponding to the change in the golf posture of the user with reference data; and controlling, by the control unit, analysis data including the analyzed golf posture of the user and the swing speed of the golf club to be displayed.

15. A computer-readable recording medium storing a computer program combined with a computer being a piece of hardware to execute a golf club speed and golf posture measuring method of a golf posture measuring mat in claim 14.

* * * * *